United States Patent [19]

Gulliver et al.

[11] Patent Number: 5,060,853

[45] Date of Patent: Oct. 29, 1991

[54] TAMPER EVIDENT CONSUMER PRODUCT PACKAGE, WINDOWED FLAT BLANK USED THEREIN, AND METHOD AND APPARATUS FOR MAKING THE BLANK

[75] Inventors: Richard F. Gulliver, Tuscaloosa, Ala.; Michael C. Linder, Monroe, La.

[73] Assignee: Gulf States Paper Corporation, Tuscaloosa, Ala.

[21] Appl. No.: 554,670

[22] Filed: Jul. 19, 1990

[51] Int. Cl.[5] ..... B65D 5/42

[52] U.S. Cl. ..... 229/162; 156/108; 156/272.4; 156/273.3; 156/332; 206/45.31; 493/905

[58] Field of Search ..... 229/162; 206/45.31, 206/45.34; 493/128, 129, 905; 156/108, 272.4, 273.3, 275.5, 275.7, 332

[56] References Cited

U.S. PATENT DOCUMENTS

| | | | |
|---|---|---|---|
| 2,662,949 | 12/1936 | Taylor | 229/162 |
| 3,190,440 | 6/1965 | Palmer | 229/162 |
| 3,245,526 | 4/1966 | Palmer | 229/162 |
| 4,097,611 | 6/1978 | Seiferth et al. | 229/162 |
| 4,252,585 | 2/1981 | Raabe et al. | 156/272.4 |
| 4,379,039 | 4/1983 | Fujimoto et al. | 156/332 |
| 4,826,004 | 5/1989 | Dupuy | 229/162 |

*Primary Examiner*—Gary E. Elkins

*Attorney, Agent, or Firm*—Cushman, Darby & Cushman

[57] ABSTRACT

A package comprising a consumable product and a sealed container containing the consumable product. The container is made up of a folded and sealed sheet of carton material having an opening therein defining a product-viewing window and a sheet of clear film material disposed over the opening so as to close the opening while retaining the product-viewing capability of the window . The clear film sheet has a marginal periphery disposed in lapped relation to a marginal periphery of the carton sheet and a wave energy curable adhesive between the marginal periphery of the clear film sheet and the marginal periphery of the carton sheet in a cured by wave energy condition bonding the clear film sheet over the carton sheet opening so that the bond cannot be rebounded by the cured adhesive once the bond provided by the cured adhesive between the sheets has been broken. The container is erected from a flat blank consisting of the carton sheet, the film sheet and the cured adhesive. A method and apparatus is disclosed for making the flat blank.

14 Claims, 4 Drawing Sheets

TAMPER EVIDENT CONSUMER PRODUCT PACKAGE, WINDOWED FLAT BLANK USED THEREIN, AND METHOD AND APPARATUS FOR MAKING THE BLANK

This invention relates to consumable product packaging and, more particularly, to a package including a consumable product contained within a carton container having an improved product-viewing window therein, to the flat blank for forming the carton container, and to a method and apparatus for making the flat blank.

The type of consumable product package herein contemplated is best exemplified by the many packages containing bakery goods as the consumable product. Typically, the containers of such packages are provided by flat blanks operable to be erected into a form to receive the bakery goods and thereafter to be sealed to provide the package. It is likewise typical for such containers to provide product-viewing windows through which the purchaser may view the bakery goods within the container.

Experience in the last several years has shown that it is highly desirable to package consumable products so that the package is tamper-evident. That is, the packaging should be such that, once sealed by the packager, the package itself should prevent access to the consumable contents and repackaging into the same condition as originally sealed.

While bakery goods packages have not been the direct victim of tampering in the past as have analgesic tablet packages, present constructions have not been rendered tamper-evident to an extent even approaching the tamper-evident features now embodied in analgesic tablet packages. For example, the existing construction of product-viewing windows involves the use of liquid adhesives, such as latex adhesives, which must be dried to adhere the clear film material to the carton material defining the window opening. It has been noted that the usual bond provided by the latex adhesive between the lapped marginal peripheral portion of the clear film sheet and the marginal peripheral portion of the carton sheet defining the opening is one which can be broken by applying a digital inward pressure on the clear film adjacent the lapped marginal peripheries. Once the bond is broken, access to the bakery goods is obtained. Moreover, where the bond is broken only along a relatively short marginal extent with the remaining bond allowed to remain intact, the broken bond portion tends to remake itself after a penetrating access is removed because of the tacky nature of the adhesive after the bond has been broken. In short, the nature of existing window bonds are such as to permit tampering access and rebonding so as to leave the package in a condition quite similar, if not virtually the same, after tampering access has been obtained than before.

The nature of the latex adhesive bonds heretofore obtained in carton-window constructions is effected by the absorption characteristics of the surface of the carton material which enters into the bond. Where the carton material is uncoated paperboard, the carton material tends to absorb some of the liquid latex adhesive which accelerates the initial formation of the bond and thereafter enhances the final bond. However, it is frequently the case, particularly with many of the bakery products, that product manufacturers will require the carton be coated on the inside surface to resist moisture penetration and product contact discoloration. The bonds provided by latex adhesives between cartons which have been coated on their interior surfaces with a suitable coating material, such as polypropylene, polyethylene or the like, are particularly troublesome because the liquid latex adhesive is not immediately absorbed by either substrate to accelerate the initial formation of the bond and enhance the final bond. Not only is the final bond easier to break but difficulties may be created in handling the cartons immediately after the formation of the initial bond has been accomplished. Accurate control of the amount of latex adhesive applied is essential in order to prevent lateral slippage between the carton and film during subsequent handling. Moreover, subsequent handling can result in movement of adhesive outwardly of the lapped marginal portions of the carton and film with the attendant likelihood of bonding parts which are not intended to be bonded.

It is an object of the present invention to provide an improved consumable product package which will eliminate the disadvantages noted above. In accordance with the principles of the present invention, this objective is obtained by providing in such a consumer product package an improvement which comprises a wave energy curable adhesive between the marginal periphery of the clear film sheet and the marginal periphery of the carton sheet in a cured by wave energy condition bonding the clear film sheet over the carton sheet opening so that the bond cannot be rebonded by the cured adhesive once the bond provided by the cured adhesive between the sheets has been broken.

Another object of the present invention is the provision of a flat blank of the type used to make the container of the package which flat blank includes a sheet of carton material cut and scored to provide a series of panels and flaps foldable into a product-receiving erected form. The sheet of carton material has an opening formed therein which provides a product-viewing window in the subsequently formed sealed container. A sheet of clear film material is disposed over the opening and has a marginal periphery disposed in lapped relation to a marginal periphery of the sheet of carton material defining the opening. Finally, a wave energy curable adhesive is disposed between the marginal periphery of the clear film sheet and the marginal periphery of the carton sheet in cured by wave energy condition bonding the clear film sheet over the product-viewing window so as to close the same while maintaining the product-viewing capability thereof in such a way that the bond cannot be rebonded by the cured adhesive once the bond provided by the cured adhesive between the sheets has been broken.

Another object of the present invention is the provision of a method of making the flat blank which includes the steps of applying a wave energy curable adhesive to one surface of one of the marginal peripheral portions. Placing the other marginal peripheral portion in lapped relation to the one marginal peripheral portion so that the wave energy curable adhesive on the one surface of the one marginal peripheral portion contacts one surface of the other marginal peripheral portion. And then subjecting the marginal peripheral portions in lapped relation with sufficient wave energy to cure the wave energy curable adhesive in bonding relation between the one surface of the lapped marginal peripheral portions.

Still another object of the present invention is the provision of an apparatus for carrying out the method on successive carton blanks which comprises a conveyor arrangement for moving successive carton sheets (1) into and out of an adhesive-applying station, (2) into and out of an assembly station, and (3) into and out of a wave energy applying station. An assembly is provided at the adhesive-applying station for applying an amount of wave energy curable adhesive to one surface of the marginal peripheral portion of each successive carton sheet while in the adhesive-applying station. A mechanism is provided at the assembly station for cutting successive clear film sheets from a roll supply of clear film material and for mounting each successive clear film sheet on a mating carton sheet while in the assembly station for movement by conveyor arrangement with the mating carton sheet in an assembled relation therewith wherein the central portion of the clear film sheet extends over the opening and the marginal peripheral portion of the clear film sheet is disposed in lapped relation with the marginal peripheral portion of the mating carton sheet and one surface of the marginal peripheral portion of the clear film is engaged with the adhesive on the one surface of the marginal peripheral portion of the mating carton sheet. Finally, an assembly is provided at the wave energy applying station for subjecting each successive clear film sheet, while in assembled relation with a mating carton sheet within the wave energy applying station, with sufficient wave energy to cure the wave energy curable adhesive.

These and other objects of the present invention will become more apparent during the course of the following detailed description and appended claims.

The invention may best be understood with reference to the accompanying drawings wherein an illustrative embodiment is shown.

IN THE DRAWINGS

Figure 1:
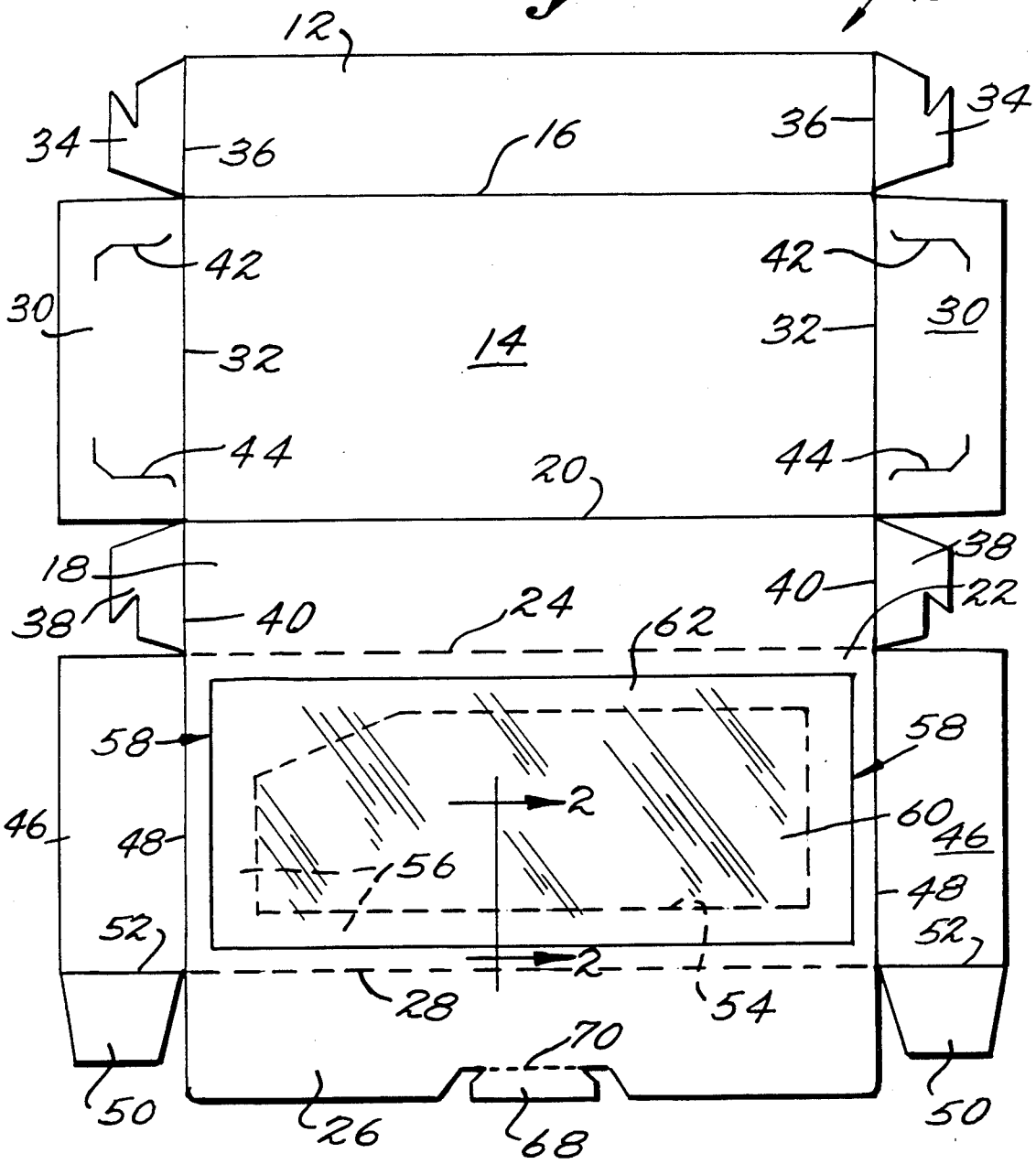
FIG. 1 is a plan view of a flat blank constructed in accordance with the principles of the present invention.

Referring now more particularly to the drawings, FIG. 1 illustrates a flat container blank, generally indicated at 10, which is constructed in accordance with the principles of the present invention. The blank 10 includes a sheet of carton material as, for example, paperboard, plastic sheet or the like, which is cut and scored to provide a series of panels, flaps and tabs. As shown, the carton sheet includes an inner front panel 12, a bottom panel 14 fixed to the inner front panel 12 along a first fold line 16, a rear panel 18 fixed to the bottom panel 14 along a second fold line 20 parallel with the first fold line 16, a top panel 22 fixed to the rear panel 18 along a fold line 24 defined by a series of spaced perforations which is parallel with the second fold line 20, and an outer front panel 26 which is fixed to the top panel 22 along a fourth fold line 28 defined by a series of spaced perforations which is parallel with the third fold line 24. The bottom panel 14 has a pair of inner side flaps 30 fixed thereto along first parallel fold lines 32 extending between the first and second fold lines 16 and 20 associated with the bottom panel 14. Front side erecting tabs 34 are fixed to the inner front panel 12 along second parallel fold lines 36 extending from one of the ends of the first parallel fold lines 32. Similar rear side erecting tabs 38 are fixed to the rear panel 18 along third parallel fold lines 40 extending from the opposite ends of the first parallel fold lines 32. The tabs 34 and 38 are formed into a conventional hook-shaped configuration adapted to enter and lock within associated conventional slits 42 and 44 respectively formed in the side flaps 30. Outer side flaps 46 are fixed to the top panel 22 along fourth parallel fold lines 48 extending from the third parallel fold lines 40. As shown, tabs 50 are fixed to the flaps 46, each along a fold line 52 which forms an extension of the fourth fold line 28 associated with the top panel 22 and outer front panel 26.

Figure 2:
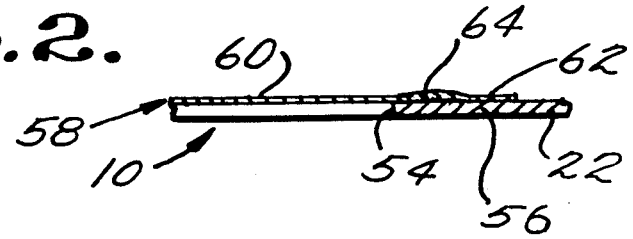
FIG. 2 is an enlarged fragmentary sectional view taken along the line 2—2 of FIG. 1.

In accordance with the principles of the present invention, the carton sheet blank 10 is formed with an opening 54. As shown, the opening 54 is in the top panel 22 although it will be understood that the opening 54 can be formed to extend into more than one panel. As shown, the top panel 22 provides a marginal peripheral portion 56 which defines the opening 54. The blank 10 also includes a sheet of clear film material, generally indicated at 58. An exemplary materials are polypropylene, polyester or acetate. The clear film sheet 58 includes a central portion 60 of a size to extend over the opening 54 and a marginal peripheral portion 62 which is of a size to be disposed in lapped relation with the marginal peripheral portion 56 of the carton sheet defining the opening 54. As best shown in FIG. 2, a line of a wave energy curable adhesive 64 is disposed between the lapped marginal peripheral portion 62 of the clear film sheet 58 and the marginal portion 56 of the carton sheet. The adhesive 64 is in a cured-by-wave-energy condition bonding the clear film sheet 58 over the product-viewing window 54 so as to close the same while retaining the product-viewing capability thereof.

Figure 3:
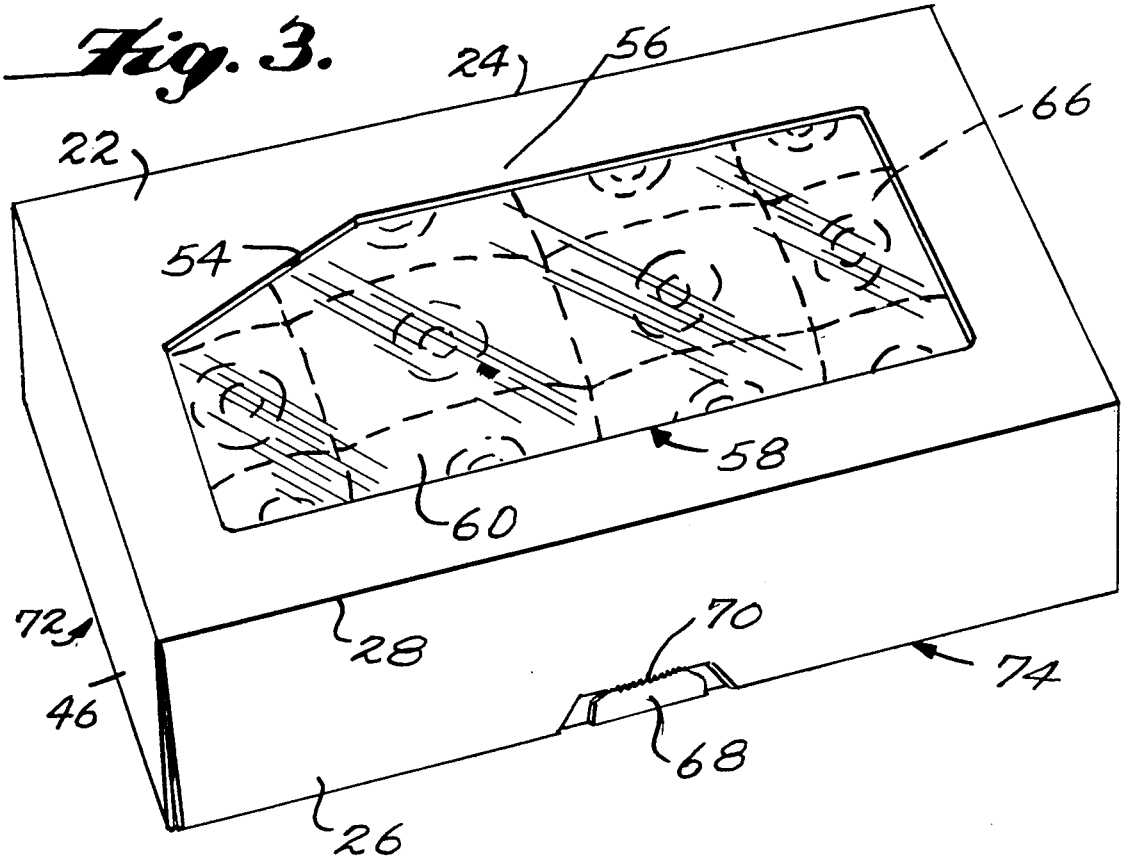
FIG. 3 is a perspective view of a consumable product package embodying the principles of the present invention, including a container which is initially erected from the flat blank shown in FIG. 1 into a form to receive the consumable product and thereafter seal to form the sealed container.

The flat blank 10, as shown in FIG. 1, is operable to be folded into an erected form for receiving a consumable product therein, as, for example, a bakery product 66, such as shown in FIG. 3. It will be understood that, while the invention is particularly suited for consumer products, it can be utilized to contain other products as well.

In the erected form of the flat blank 10, the side flaps 30 attached to the bottom panel 14 are folded upwardly along fold lines 32 and the inner front and rear panels 12 and 18 are likewise folded upwardly along fold lines 16 and 20, respectively. The tabs 34 and 38 are then folded inwardly along fold lines 36 and 40 and inserted in the associated slits 42 and 44, respectively so that the hooked ends are inwardly. The tabs 34 and 38 thus serve to retain the inside front panel 12, the rear panel 18, and the side flaps 30 in upwardly extending relation with respect to the bottom panel 14 forming a tray for receiving the bakery goods 66. After the bakery goods have been placed within the tray structure, the top panel 22 is hinged into closed relation with the tray along fold line 24, the outside side flaps 46 are then folded down along fold lines 48, tabs 50 are folded in along fold lines 52, and finally the outer front panel 26 is folded down along fold line 28 with the inner surface of the ends being glued to the outer surface of tabs 50. In addition, an opening tab 68 which is formed on the lower central edge portion of the outer front panel 26 and defined by a series of spaced slits 70 likewise has its inner surface glued to the outer surface of an adjacent portion of the inner front panel 26. The carton-to-carton gluing of the folding tabs 50 and removable tab 60 serves to enclose the carton around the bakery goods. The glued relationship of the tabs 50 and 68 is usually accomplished by using hot melt adhesives which are not suitable for window constructions because of the bulk required. Moreover, in both instances, at least one adhesive contacting surface will not be coated and, where coating is not utilized, both surfaces will be absorptive. The result is a bond which cannot be easily broken. It is much easier to separate the opening tab 68 from the remainder of the outer front panel 26 by breaking it along the perforated line 70. This permits the top panel 22 with the outer front panel 26 and outer side flaps 46 extending downwardly therefrom to be hinged upwardly along the hinge line 24 to provide normal access.

As best shown in FIG. 3, a consumable product package, generally indicated at 72, is made up of a container, generally indicated at 74, formed from the flat blank 10 having the bakery goods 66 enclosed therein but viewable through a tamper-evident product-viewing window provided by the opening 54, the clear film sheet 58 and the adhesive 64. The bond provided by the wave-energy-cured adhesive 64 between the lapped marginal portions of the film sheet 58 and carton sheet is such that any attempt to break the bond results merely in the carton material fracturing so that there is no tacky surface exposed which could be readily rebonded. It is difficult, indeed, to break the bond along a short length of the lapped peripheries 54 and 62 so that any attempt to break the bond results in displacement of the film sheet 58 from the carton sheet making the break evident, by inspection or to the touch.

Figure 6:
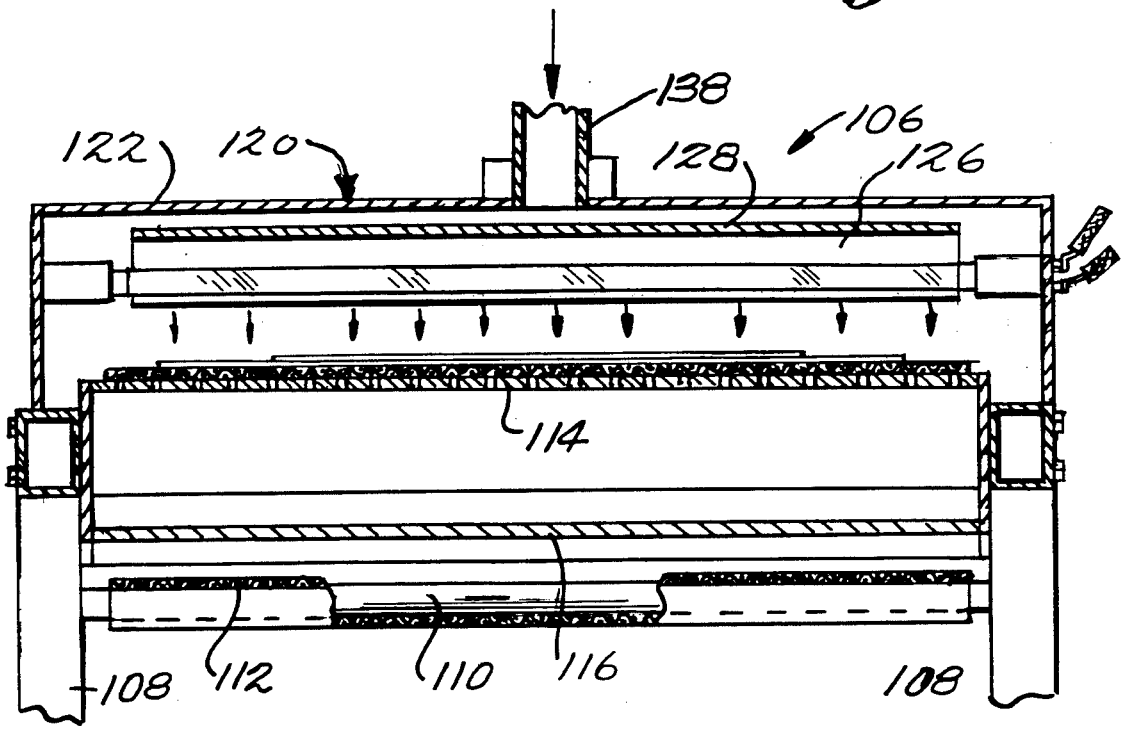
FIG. 6 is a fragmentary sectional view taken along the line 6—6 of FIG. 5.
Figure 4:
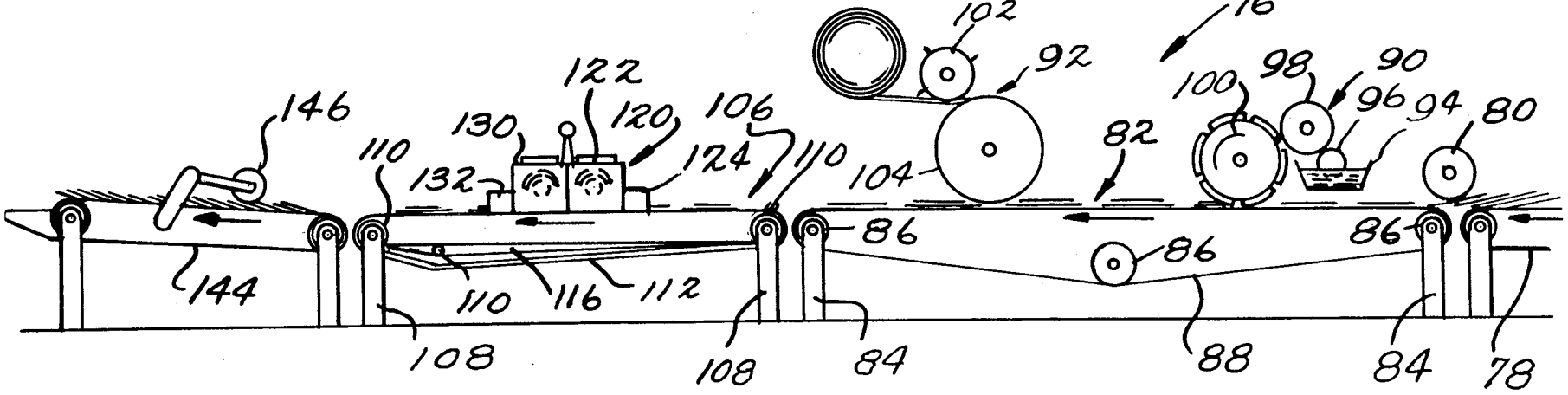
FIG. 4 is a somewhat schematic view of an apparatus for making the flat blank shown in FIG. 1.
Figure 5:
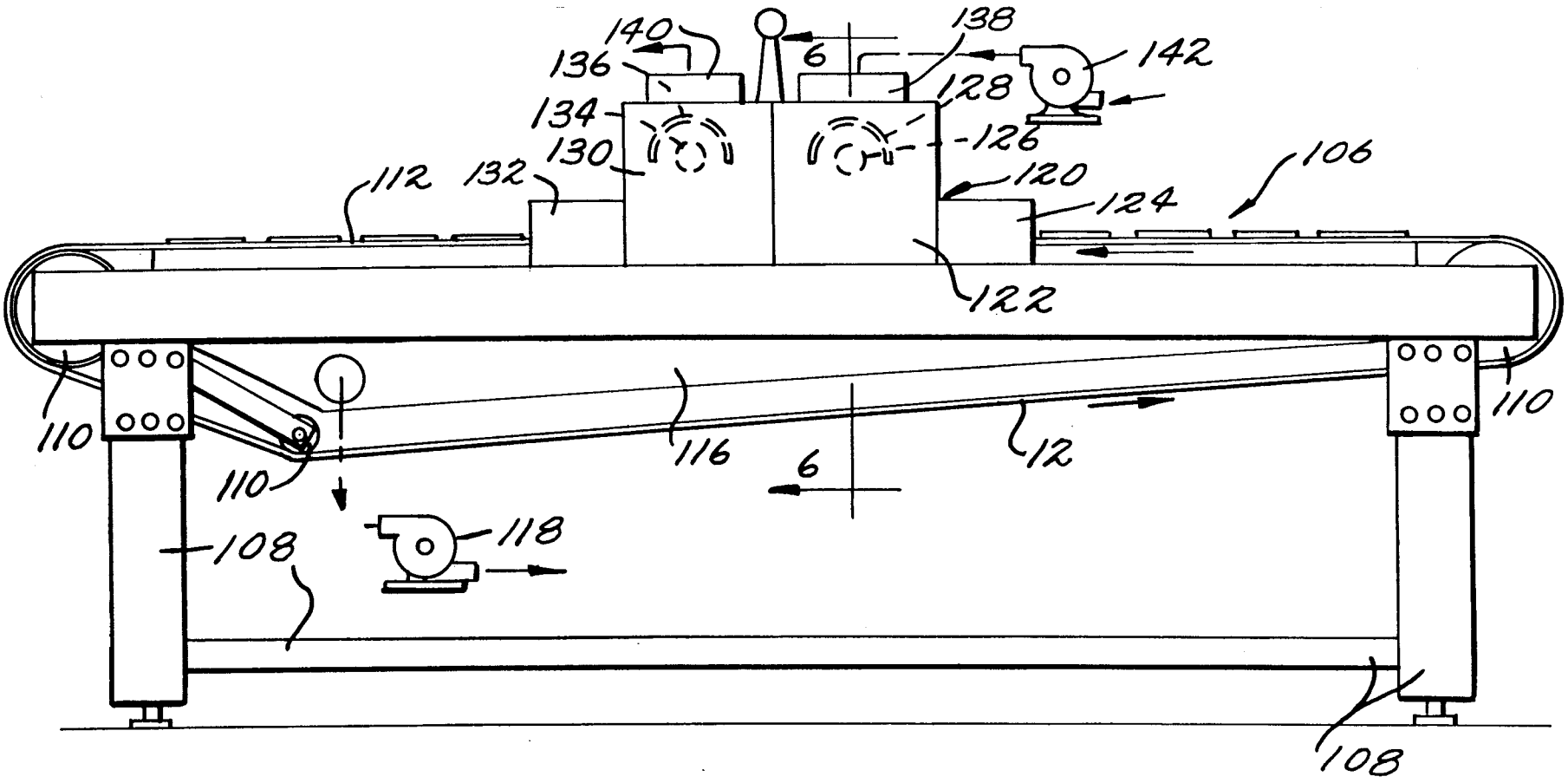
FIG. 5 is a side elevational view of the portion of the apparatus which includes the wave energy applying station.

FIGS. 4–6 illustrate apparatus, generally indicated at 76, for performing the method of the present invention to form the flat blank 10 of FIG. 1. The apparatus 76 preferably includes certain known components which heretofore have been utilized in assembling clear film sheets over openings in carton sheets with latex adhesives. For example, as shown in FIG. 4, a stacked supply of carton sheets are fed to a supply conveyor 78 where they are shingled and carried to a discharge roller 80 which serves to feed successive carton sheets in spaced relation onto a conventional window applying machine, generally indicated at 82.

The machine 82 includes a suitable frame 84 on which a series of rollers 86 are rotatably mounted. A foraminous endless belt 88 is trained about the rollers 86 so as to provide an upper operative run or flight and a return flight. The operative flight of the belt receives successive carton sheets and carries them into and out of an adhesive applying station, generally indicated at 90 and into and out of an assembly station, generally indicated at 92.

At the adhesive applying station 90, an adhesive tray 94 is suitably supported on the frame. In accordance with the principles of the present invention, the adhesive 64 which is supplied to the tray 94 is a wave energy curable adhesive. The wave energy curable adhesive may be of the ultraviolet light curable type or of the election beam curable type. A preferred embodiment is the ultraviolet wave activated adhesive designated 8152 manufactured by Northwest Coatings Corp. The adhesive is a formulation of an acrylate ester urethane resin, a mono-functional monomer and a photo sensitizer. Other examples of wave curable adhesives which may be utilized are disclosed in U.S. Pat. Nos. 4,379,039 and 4,533,723, the disclosures of which are hereby incorporated by reference into the present specification.

The adhesive 64 in the tray 94 is picked up by a supply roller 96 and is transferred, as by a transfer roller 98, onto a pattern roller 100. The pattern roller 100 serves to apply the adhesive transferred thereto by the transfer roller 98 on to successive carton sheets while successive carton sheets are moved into and out of the adhesive applying station 90. As shown, the adhesive pattern is a line or continuous strip pattern applied on the interior surface of the peripheral portion 56 of each carton sheet spaced slightly away from the edge which defines the carton opening 54. It will be understood that the pattern need not be a continuous strip but may be a discontinuous strip or dots or the like.

Mounted at the assembly station 92 is a roll supply of clear film material which is fed between a pair of cooperating rollers 102 and 104. Roller 102 is a bladed cutting roller which cuts individual clear film sheets 58 from the roll supply. Roller 104 is a transfer roller 102 which serves to transfer successive clear film sheets 58 in assembled relation on successive carton sheets. In the assembled relation, the central portion 60 of the clear film sheet 58 extends over the opening 54 in the carton sheet and the marginal peripheral portion 62 thereof extends in overlapping relation with the marginal peripheral portion 56 of the carton sheet. In the assembled relationship, the exterior surface of the marginal peripheral portion 62 of the clear film sheet 68 is in contacting engagement with the pattern of adhesive applied to the interior surface of the marginal peripheral portion 56 of the carton sheet.

The operative flight of the endless foraminous belt 88 of the window applying machine 82 serves to discharge successive carton sheet-adhesive-film sheet assemblies onto a wave energy adhesive curing machine, generally indicated at 106.

The wave energy curing machine 106 includes a frame construction 108 on which a series of rollers 110 are rotatably mounted. An endless foraminous belt 112 is trained about the rollers to form an upper operative flight and a lower return flight. As best shown in FIG. 6, the operative flight is supported on a perforated plate 114 which forms the top of a vacuum box 116. A vacuum pump 118, schematically illustrated in FIG. 5, draws air from the vacuum box 116 which, in turn, causes outside air to pass through the operative flight of the foraminous belt 112 and the perforated plate 114 supporting the same. This tendency for the flow of outside air serves to retain successive assembled carton and clear film sheets on the operative flight of the belt and to insure a certain degree of pressure between the lapped marginal portions of the sheets.

A construction similar to the perforated sheet-vacuum box arrangement is preferably utilized in conjunction with the foraminous belt 88 of the window applying machine 82 to provide for better control and retention of the carton sheets into and out of the adhesive applying station 90 and into the assembly station 92 and the assembled carton and clear film sheets out of the assembly station and transfer thereof onto the foraminous belt 112 of the wave energy curing machine 106.

The operative flight of the foraminous belt 112 serves to move successive carton-clear film sheet assemblies into and out of a wave energy applying station, generally indicated at 120. At the wave energy applying station 120, there is mounted an inlet housing assembly 122 having an inlet 124 for the passage of successive sheet assemblies within the inlet housing assembly. Mounted within the inlet housing assembly 122 is a first ultraviolet lamp assembly including a first ultraviolet light tube 126 and a first overhead reflector 128. Mounted at the wave energy applying station 120 in communicating relation with the inlet housing assembly 122 is an outlet housing assembly 130 having an outlet 132 through which successive flat blanks 10 pass out of the outlet housing assembly. The outlet housing assembly 130 has a second ultraviolet lamp assembly therein including a second ultraviolet light tube 134 and overhead reflector 136.

In order to control the temperature of the environment within the housing assemblies 122 and 130, an inlet pipe 138 extends into the roof of the inlet housing assembly 122 and an outlet pipe 140 extends out of the roof of the outlet housing assembly 130. As schematically illustrated in FIG. 5, an adjustable speed fan assembly 142 has its discharge connected with the inlet so as to provide a flow of relatively cool atmospheric air into and out of the interior of the housing assemblies. The regulation of the temperature within the housings is simply to prevent overheating. The particular temperature conditions do not particularly affect the actual curing of the adhesive 64 of successive flat blanks 10 as they pass into and out of the wave energy applying station 120.

An exemplary wave energy application within the station 120 sufficient to effect cure of the adhesive 64 of each successive flat blank 10 is as follows. The ultraviolet light tubes 126 and 134 utilized are each 42" 200–400 nanometers wave length 1500 wattage tubes manufactured by Western Quartz Co. An exemplary linear speed of the operative run of the belt 112 which is continuous and coordinated with the speed of the belt 88 is 150 feet per minute. These exemplary conditions result in the application of each flat blank to ultraviolet light for something less than 1 second.

In the apparatus 76 shown in FIG. 4, the operative flight of the foraminous belt 112 serves to discharge successive flat blanks 10 onto a discharge conveyor 144 having a shingling roller 146 thereon. From the discharge conveyor 144, the flat blanks are counted and shipped.

It thus will be seen that the objects of this invention have been fully and effectively accomplished. It will be realized, however, that the foregoing preferred specific embodiment has been shown and described for the purpose of this invention and is subject to change without departure from such principles. Therefore, this invention includes all modifications encompassed within the spirit and scope of the following claims.

What is claimed is:

1. In a package comprising a consumable product and a sealed container containing said consumable product, said container being defined by a folded and sealed sheet of carton material having an opening therein defining a product-viewing window and a sheet of clear film material disposed over said opening so as to close the opening while retaining the product-viewing capability of the window, said clear film sheet having a marginal periphery disposed in lapped relation to a marginal periphery of said carton sheet, the improvement which comprises a wave energy curable adhesive between the marginal periphery of said clear film sheet and the marginal periphery of said carton sheet in a cured by wave energy condition bonding the clear film sheet over said carton sheet opening so that said bond cannot be rebonded by said cured adhesive once the bond provided by said cured adhesive between said sheets has been broken.

2. The package improvement as defined in claim 1 wherein said consumable product is bakery goods, said carton material is paperboard and said clear film material is selected from the group consisting of polypropylene, polyester and acetate.

3. The package improvement as defined in claim 2 wherein said paperboard has the surface thereof defining the interior of said package coated with plastic.

4. The package improvement as defined in claim 3 wherein said wave energy curable adhesive is an adhesive curable by exposure to ultraviolet light which consists essentially of an acrylate ester urethane resin, a mono-functional monomer and a photo sensitizer.

5. A flat container blank operable to be erected into a form for receiving a product and thereafter to be sealed to provide a sealed container having a product therein, said flat container blank comprising a sheet of carton material cut and scored to provide a series of panels and flaps foldable into the aforesaid erected form, said sheet of carton material having an opening formed therein which provides a product viewing window in the sealed container, a sheet of clear film material disposed over said opening and having a marginal periphery disposed in lapped relation to a marginal periphery of said sheet of carton material defining said opening, and a wave energy curable adhesive between the marginal periphery of said clear film sheet and the marginal periphery of said carton sheet in a cured by wave energy condition bonding the clear film sheet over said product-viewing window so as to close the same while maintaining the product viewing capability thereof in such a way that the bond cannot be rebonded by said cured adhesive once the bond provided by said cured adhesive between said sheets has been broken.

6. A blank as defined in claim 5 wherein said carton material is paperboard and said clear film material is selected from the group consisting of polypropylene, polyester and acetate.

7. A blank as defined in claim 6 wherein said paperboard has the surface thereof defining the interior of said package coated with plastic.

8. A blank as defined in claim 7 wherein said wave energy curable adhesive is an adhesive curable by exposure to ultraviolet light which consists essentially of an acrylate ester urethane resin, a mono-functional monomer and a photo sensitizer.

9. A blank as defined in claim 8 wherein said series of panels includes an inner front panel, a bottom panel fixed to said front panel along a first fold line, a rear panel fixed to said bottom panel along a second fold line parallel to said first fold line, a top panel fixed to said rear panel along a third fold line parallel with said second fold line, and an outer front panel fixed to said top panel along a fourth fold line parallel with said third fold line.

10. A blank as defined in claim 9 wherein said bottom panel includes inner side flaps fixed to said bottom panel along first parallel fold lines extending between said first and second fold lines and inner side erecting tabs fixed to said inner front panel and said rear panel along second and third parallel fold lines respectively extending from ends of the first parallel fold lines, said tabs being cooperable with said side flaps to maintain said inner front panel, said rear panel and said inner side flaps in perpendicular upstanding relation with respect to said bottom panel, said top panel having outer side flaps fixed thereto along fourth parallel fold lines extending from said third parallel fold lines.

11. A blank as defined in claim 10 wherein said opening and said marginal periphery defining the same are provided in said top panel.

12. A process for forming a carton blank comprising a sheet of carton material having an opening therein and a marginal peripheral portion surrounding said opening and a sheet of clear film having a central portion sufficient to extend over said opening and a marginal peripheral portion sufficient to extend over the marginal peripheral portion of said carton sheet, said process comprising the steps of applying a wave energy curable adhesive to one surface of one of said marginal peripheral portions, placing the other marginal peripheral portion in lapped relation to said one marginal peripheral portion so that said wave energy curable adhesive on the one surface of said one marginal peripheral portion contacts one surface of the other marginal peripheral portion, and subjecting the marginal peripheral portions in said lapped relation with sufficient wave energy to cure the wave energy curable adhesive in bonding relation between the one surfaces of said lapped marginal peripheral portions.

13. A process as defined in claim 12 wherein the marginal peripheral portions are subjected to ultraviolet light.

14. A process as defined in claim 13 wherein the wave energy curable adhesive consists essentially of an acrylate ester urethane resin, a mono-functional monomer and a photo sensitizer.

* * * * *